United States Patent [19]

Takahashi et al.

[11] Patent Number: 4,752,038

[45] Date of Patent: Jun. 21, 1988

[54] CRUSHER FOR CRUSHING METAL BLOCKS

[75] Inventors: Teigo Takahashi, Kodaira; Kaoru Okazaki, Ichikawa, both of Japan

[73] Assignee: Tezuka Kosan Kabushiki Kaisha, Tokyo, Japan

[21] Appl. No.: 8,281

[22] Filed: Jan. 29, 1987

[30] Foreign Application Priority Data

Jan. 30, 1986 [JP] Japan ..... 61-10919

[51] Int. Cl.[4] ..... B02C 4/08; B02C 4/20

[52] U.S. Cl. ..... 241/158; 241/167; 241/236

[58] Field of Search ..... 241/166, 167, 236, 235, 241/158, 159, 160

[56] References Cited

U.S. PATENT DOCUMENTS 2,894,697 7/1959 Panning et al. ..... 241/236 X 4,377,259 3/1983 Areaux et al. ..... 241/236 X

*Primary Examiner*—Mark Rosenbaum

[57] ABSTRACT

The crusher of the present invention is for crushing metal blocks obtained by compressing abandoned cars and metal scraps, where the inside of the casing having a discharge opening is equipped with pressing rolls in the upper part, a crushing roll arranged in the middle below the pressing rolls and a pressing body arranged close to the crushing roll, where the pressing rolls and the crushing roll are provided with blades protruding from the circumference, while the pressing body is provided with pressing blades on its circumference near the crushing roll and is arranged so that it can freely come closer to or away from the crushing roll.

3 Claims, 2 Drawing Sheets

CRUSHER FOR CRUSHING METAL BLOCKS

BRIEF SUMMARY OF THE INVENTION

In the conventional way of recycling large-sized metal scraps, the scraps were in the first place as a preparatory step cut into prescribed size by means of a shearing machine and then the cut blocks were crushed into finished metal scraps.

However, the way to cut as a preparatory treatment the large-sized metal scrap blocks by using a shearing machine produces cut scraps bigger in volume than a certain convenient size. Therefore, it is necessary to further crush the bigger-sized metal scraps to smaller size proper to be used finally as recycled scraps. Accordingly, the crusher required for this purpose must be big in size and lead to high cost in scrap crushing.

The object of this invention is, therefore, to present a crusher that is able to crush large-sized metal scraps roughly as a preparatory treatment to the size smaller than the size provided by the conventional shearing machine. As a result the crusher proper that is used for making chips from the metal scraps as a final stage can be smaller in size and functions as effective tool for cost reduction.

The characteristics of the present invention lie in that a pair of pressing rolls are arranged inside the crusher casing having an opening, a crushing roll being provided in the middle below the pressing rolls so that the pressing rolls and the crushing roll form an inverted triangle, a pressing body being arranged against the crushing roll so that it can freely come closer to or away from the crushing roll.

For this reason, the present invention makes it possible to crush large-sized metal scraps into a size smaller than the conventional way of using a machine, and thus to make smaller the size of the crusher proper for finally making chips from metal scraps, and is effective for achieving cost reduction.

DETAILED DESCRIPTION

A present invention relates to the crusher to be used for crushing metal blocks made from the compression, for instance, of the abandoned cars, metal scraps, etc.

Figure 1:
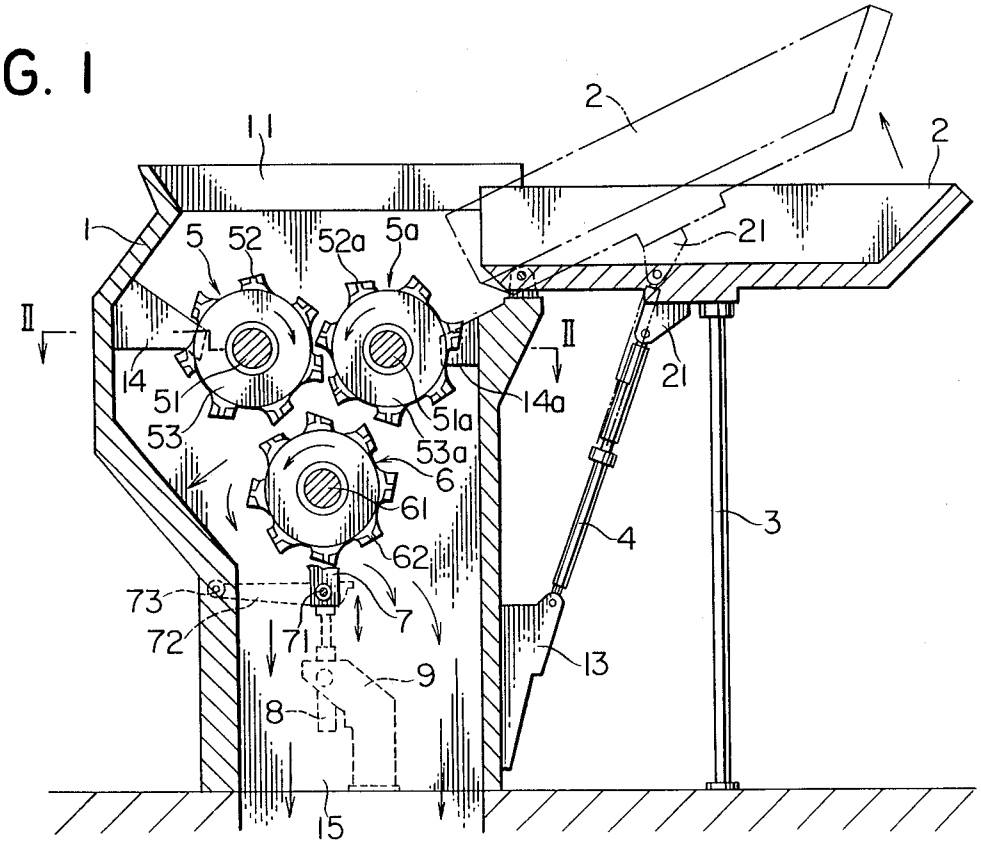
FIG. 1 is a sectional view.

As shown in FIG. 1, the crusher casing 1 has on its upper end an inlet opening 11, which is equipped with a bracket protruding on its upper end on the right hand side, through which the chute 2 is supported on the shaft in the way that allows free rotation.

The chute 2 is supported horizontally by being contact fit on the upper surface of the support column 3 and the metal scraps are fed when the machine is in this position. Further, a bracket 21 is provided in the rear surface of chute 2, and also the lower end of the side of the crusher casing 1 has a protruding bracket 13, where the end of oil hydraulic cylinder 4 is connected to the bracket 13 with freedom of rotation, Ram end of the oil hydraulic cylinder 4 is connected to the bracket 21 with freedom of rotation. Therefore, by feeding working oil to the oil hydraulic cylinder 4, the chute 2 is driven to pivot along the center of bracket 21.

The inside construction of the crusher casing 1 is described as follows. The upper part of the casing is equipped with a pair of pressing roll 5, 5*a* horizontally arranged, where both ends of the roll shaft 51, 51*a* of the pressing rolls are supported by the casing in the manner that the rolls can rotate freely, and further, it is so constructed that the rotating power of the driving motor (not shown in the drawing) can be transmitted to these roll shafts, which, as a result can be rotated in both directions but are rotated only in the inward direction when used for scrap crushing.

Figure 2:
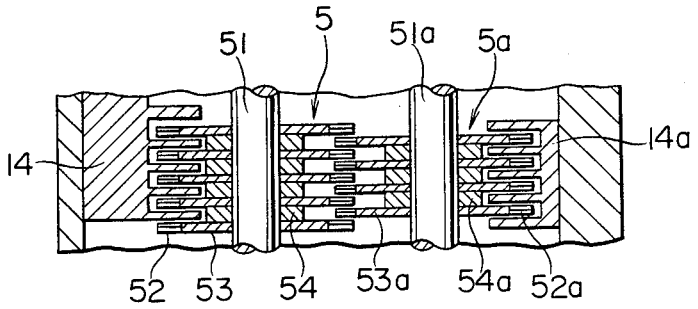
FIG. 2 is a sectional view according to the line II—II of FIG. 1.

As shown in FIG. 2, the pressing rolls 5, 5*a* are so constructed that large roll plates 53, 53*a* have on their circumference a multiple of radially arranged pressing blades 52, 52*a* (7 pieces in the case of FIG. 2) as well as smaller roll plates 54, 54*a* having a diameter smaller than large roll plates and arranged alternately therebetween. For this purpose, the pressing blades 52, 52*a* are so arranged as to have a certain distance with each other in the axial direction of the rolls 5, 5*a*. Further, the relative position of the large roll plates 53 and 53*a* that have pressing blades as well as the relative position of the small roll plates 54 and 54*a* are so arranged that the end part of the pressing blade 52, 52*a* come closest to the opposite roll plate 54, 54*a*. The shape of both front and rear ends of the pressing blades 52, 52*a* are formed to have a sharp edge and is hexagonal as a whole. Further, the blades of chasing plates 14, 14*a* protruding inward from the inner wall of the crusher casing extend in the clearance between the pressing blades 52, 52*a* of pressing rolls 5, 5*a*, i.e. the blades intermesh.

Further, as shown in FIG. 1, a crushing roll 6 is positioned in the middle below the engaging parts of the pressing rolls 5, 5*a*. The pressing rolls on the upper side and the crushing roll on the lower side form, as an inverted whole, a triangle. The crushing roll 6 is driven and rotated by the rotary shaft 61 and is constructed in the same way as the pressing rolls 5, 5*a* and equipped with the crushing rolls extending radially at a prescribed distance on the circumference of the roll.

Further, below the crushing roll 6 is positioned a pressing body 7. The shaft 71, one end of which is fixed to the pressing body, protrudes to the outside of the crusher casing 1. The outer end 73 of the shaft 73 is fixed 22 an end of the driving lever 72, the base end of which is supported to the crusher casing 1 which pivots about shaft end 73. Also, ram end of the oil hydraulic cylinder 8 is connected to the lower face of the driving lever 72. The oil hydraulic cylinder is supported with freedom of rotation by the bracket 9 arranged on the bottom outside the crusher casing 1. The bottom of the crusher casing 1 forms a discharge opening 15.

Next, the function of metal scrap crushing is described according to the present invention.

Metal scraps fed into the crusher casing 1 by the chute 2 from the inlet opening 11 is put between the pressing rolls 5, 5*a* respectively rotating inward and is to some extent crushed in such a way that it is deformed, bored and so on. In this case, if too much metal scrap is put between the pressing rolls causing an overload, both pressing rolls 5, 5*a* are rotated in the reverse direction which will solve the problem. The revolution speed of the pressing roll 5*a* of right hand side is set faster than the speed of the other pressing roll 5 of the lefthand side, in order to increase the pressing efficiency.

The metal scraps, crushed to some extent, are scattered by the crushing roll 6 in its rotating direction and discharged from the discharge opening 15. The revolution speed of the crushing roll 6 is same as that of the pressing roll 5 and is slower than that of the pressing roll 5*a*.

The metal scraps, that were not completely crushed by the crushing roll 6 but were entangled with the crushing roll 6, are crushed by the blade of the pressing body 7 and discharged from the discharge opening 15. Further, the distance between the crushing roll 6 and the pressing body 7 can be adjusted by the up and down movement of the pressing body, that is to say, the crushing rate of metal scraps can be adjusted.

We claim:

1. A crusher comprising a casing having an inlet opening and a discharge opening, a pair of pressing rolls horizontally disposed in the upper part of the interior of the casing, a crushing roll disposed in the middle below the pressing rolls so that the pressing rolls and the crushing roll from an inverted triangle and a pressing body arranged close to and below the crushing the roll, the pressing rolls and the crushing roll being provided with radially protruding blades on the circumference thereof and having freedom of rotation, the pressing body being equipped with pressing blades in the circumference thereof near the crushing roll and arranged so that the pressing body can freely come close to or back away from the crushing roll, the pressing rolls and crushing roll being provided with driving and rotating means, and the pressing body being provided with driving means for moving close to and away from the crushing roll.

2. A crusher according to claim 1, wherein the pressing rolls are able to rotate in both directions.

3. A crusher according to claim 1, wherein the revolution speed of the pressing rolls are different with each other.

* * * * *